US008752942B2

(12) United States Patent
Wei et al.

(10) Patent No.: US 8,752,942 B2
(45) Date of Patent: Jun. 17, 2014

(54) MULTIFUNCTIONAL PRINTER

(71) Applicants: Cal-Comp Electronics & Communications Company Limited, New Taipei (TW); Kinpo Electronics, Inc., New Taipei (TW)

(72) Inventors: Chung-Hsin Wei, New Taipei (TW); Hung-Huan Sung, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 10 days.

(21) Appl. No.: 13/747,439

(22) Filed: Jan. 22, 2013

(65) Prior Publication Data

US 2014/0085391 A1 Mar. 27, 2014

(30) Foreign Application Priority Data

Sep. 21, 2012 (TW) ..... 101134810 A

(51) Int. Cl.
*B41J 2/175* (2006.01)

(52) U.S. Cl.
CPC ..... *B41J 2/17509* (2013.01); *B41J 2/1752* (2013.01)
USPC ..... 347/85

(58) Field of Classification Search
USPC ..... 347/84, 85
See application file for complete search history.

(56) References Cited

U.S. PATENT DOCUMENTS

| | | | | |
|---|---|---|---|---|
| 4,893,137 | A * | 1/1990 | Ebinuma et al. | 346/134 |
| 5,245,365 | A * | 9/1993 | Woodard et al. | 347/86 |
| 2004/0085398 | A1 * | 5/2004 | Hirashima et al. | 347/49 |
| 2012/0050416 | A1 | 3/2012 | Ishizawa et al. | |

FOREIGN PATENT DOCUMENTS

| | | |
|---|---|---|
| TW | I321527 | 3/2010 |

* cited by examiner

*Primary Examiner* — Huan Tran
(74) *Attorney, Agent, or Firm* — Jianq Chyun IP Office

(57) ABSTRACT

A multifunctional printer including a body, a cover, a print head, an ink delivery module, an ink delivery pipe and a driving module is provided. The cover is pivoted to the body, such that the cover is open relative to the body, and therefore elements in the body are exposed. The print head and the ink delivery module are both disposed in the body, wherein the ink delivery module having multiple color cases is located adjacent to the cover. The ink delivery pipe is connected between the print head and the ink delivery module. The driving module includes a first driving element and a second driving element, wherein the first driving element is disposed on the ink delivery module while the second driving element is disposed on at least one of the body and the cover and engages with the first driving element.

15 Claims, 3 Drawing Sheets

MULTIFUNCTIONAL PRINTER

CROSS-REFERENCE TO RELATED APPLICATION

This application claims the priority benefit of Taiwan application serial no. 101134810, filed on Sep. 21, 2012. The entirety of the above-mentioned patent application is hereby incorporated by reference herein and made a part of this specification.

BACKGROUND

1. Field of the Invention

The invention relates to a multifunctional printer, and more particularly, to a multifunctional printer that allows users to add ink conveniently.

2. Description of Related Art

Inkjet printers are easy to operate and may print on a variety of inkjet media; these advantages make inkjet printers widely popular with the public. However, after the inkjet printers are used for a period of time, ink inside the ink cartridges is used up, and thus new ink cartridges are used to replace the old ones. Currently, a common replacement method is to dismantle the ink cartridges in which ink is used up, throw the ink cartridges away and then install new ink cartridges. However, this method not only wastes resources because the ink cartridge bodies cannot be reused but also increases the user's expense insidiously because the ink cartridges are expensive.

In another current ink delivery system, ink delivery containers are disposed outside the inkjet printers, and pipes are used to connect the ink delivery containers and the ink cartridges disposed inside the inkjet printers, and the ink are delivered from the ink delivery containers into the ink cartridges by the principle of vacuum ink filling. Though this method achieves environmental protection and cost-saving effects, space outside the inkjet printers are occupied because the ink delivery containers are disposed outside the inkjet printers.

SUMMARY OF THE INVENTION

The invention provides a multifunctional printer, and an ink delivery module of the multifunctional printer is exposed when a cover is open relative to a body, which allows users to add ink conveniently.

The invention provides a multifunctional printer including a body, a cover, a print head, an ink delivery module, an ink delivery pipe and a driving module. The cover is pivoted to the body, such that the cover is open relative to the body, and therefore elements in the body are exposed. The print head and the ink delivery module are both disposed in the body, wherein the ink delivery module having multiple color cases is located adjacent to the cover. The ink delivery pipe is connected between the print head and the ink delivery module. The driving module includes a first driving element and a second driving element, wherein the first driving element is disposed on the ink delivery module while the second driving element is disposed on at least one of the body and the cover and engages with the first driving element.

Based on the above, the cover of the multifunctional printer of the invention may be open relative to the body, so that the ink delivery module is exposed outside the body, which allows the users to add ink conveniently.

In order to make the aforementioned features and advantages of the invention more comprehensible, embodiments accompanying figures are described in details below.

BRIEF DESCRIPTION OF THE DRAWINGS

The accompanying drawings are included to provide further understanding and are incorporated in and constitute a part of this specification. The drawings illustrate exemplary embodiments and, together with the description, serve to explain the principles of the invention.

DESCRIPTION OF EMBODIMENTS

Current multifunctional printers achieve the effect of ink delivery by changing ink cartridges or by disposing ink delivery containers outside bodies of the multifunctional printers. However, for users, when changing the ink cartridges, the users have to change the cartridge bodies of the ink cartridges in good condition together, which is not environmentally friendly at all. In addition, disposing ink delivery containers outside the bodies of the multifunctional printers occupies space. Therefore, embodiments are provided below to exemplify how to be environmental protection by reusing the cartridge bodies of the ink cartridges without changing the ink cartridges inside the multifunctional printers through cooperation of mechanism. In addition, there is no need to dispose ink delivery containers outside the bodies of the multifunctional printers, and thus space outside the bodies of the multifunctional printers is not occupied.

It should be mentioned that herein, directional or relative descriptions, such as inside, outside, above, under, left, right, clockwise and counter-clockwise, are described according to relative positions of elements shown in drawings of corresponding embodiments and are not intended to limit the invention.

First Embodiment

Figure 1:
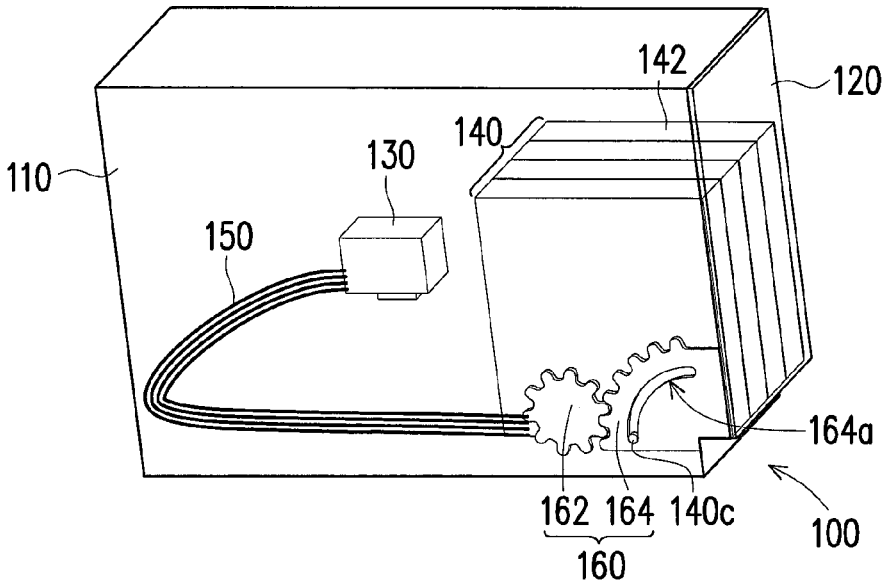
FIG. 1 is a schematic view of a multifunctional printer according to the first embodiment of the invention, wherein a cover is not open relative to a body.

FIG. 1 is a schematic view of a multifunctional printer according to the third embodiment of the invention. Referring to FIG. 1, a multifunctional printer 100 of the present embodiment has functions of scanning, photocopying and printing and includes a body 110, a cover 120, a print head 130, an ink delivery module 140, an ink delivery pipe 150 and a driving module 160. The cover 120 is pivoted to the body 110, such that the cover 120 is open relative to the body 110, and therefore elements (not shown) in the body 110 are exposed. The print head 130 is disposed in the body 110. The ink delivery module 140 is disposed adjacent to the cover 120 in the body 110, and the ink delivery module 140 has multiple color cases (not indicated). The ink delivery pipe 150 is connected between the print head 130 and the ink delivery module 140. The driving module 160 includes a first driving element 162 and a second driving element 164, wherein the first driving element 162 is disposed on the ink delivery module 140 while the second driving element 164 is disposed in the body 110 and engages with the first driving element 162.

In detail, the ink delivery module 140 includes a yellow case, a red case, a blue case and a black case. Case bodies 142 of each of the cases and the cover 120 are made of light-transmissive materials, such as transparent or semitransparent materials, so that the users may determine whether to add ink through visual judgment.

In the present embodiment, both the first driving element 162 and the second driving element 164 are gears, and the first driving element 162 and the second driving element 164 engage with each other, so that when one of the driving elements (such as the second driving element 164) rotates, the other driving element (such as the first driving element 162) will be led to operate. In addition, the second driving element 164 has a guide groove 164*a*, and the ink delivery module 140 has a protruding axis 140*c*, and the protruding axis 140*c* penetrates into the guide groove 164*a* so as to be guided and limited in position by the guide groove 164*a*. In addition, the multifunctional printer 100 further includes a damping element (not shown) connected between the first driving element 162 and the second driving element 164, and the damping element is a torsional spring. People of ordinary skill in the art can learn that in another unshown embodiment, the second driving element 164 may be the one that has the protruding axis 140*c*, and the ink delivery module 140 has the guide groove 164*a*, and the protruding axis 140*c* likewise penetrates into the guide groove 164*a* so as to be guided and limited in position by the guide groove 164*a*.

How the ink is added to the multifunctional printer of the present embodiment is explained in the following with accompanying drawings.

Referring to FIG. 1, in a normal using state (such as scanning, printing or photocopying), the cover 120 is closed relative to the body 110. Therefore, components inside the body 110, such as the print head 130, the ink delivery pipe 150 or other electronic or mechanical parts are covered and not exposed to the outside. At this time, each case of the ink delivery module 140 stands in the body 110 and is connected to the print head 130 through the ink delivery pipe 150, so as to provide ink to the print head 130 for printing or photocopying.

Figure 2:
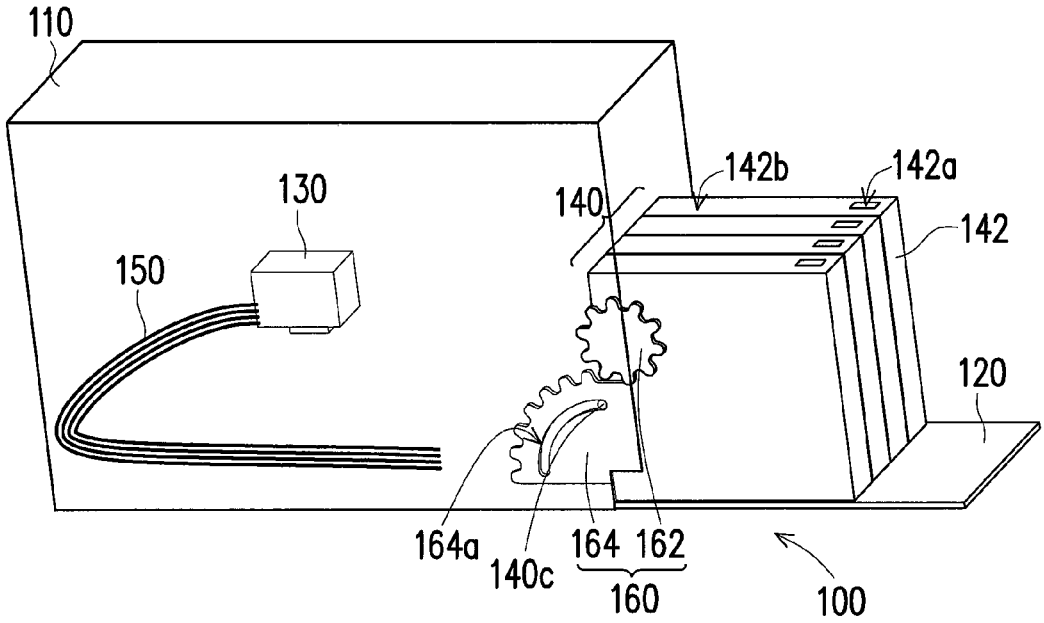
FIG. 2 is a schematic view of the multifunctional printer shown in FIG. 1, wherein the cover is open relative to the body.

Because the case bodies 142 of each of the cases and the cover 120 are made of light-transmissive materials, the users may know the amount of the ink in the cases through visual judgment. When the user thinks ink should be added, the user first opens the cover 120 relative to the body 110, and then the ink delivery module 140 tilts toward the opened cover 120 clockwise through a manual or an automatic mechanism as shown in FIG. 2. In the manual operation, after the user opens the cover 120 relative to the body 110, the user may make the second driving element 164 and the first driving element 162 rotate relative to each other and therefore lead the ink delivery module 140 to tilt toward the opened cover 120 clockwise in a manual way, such as pressing buttons or moving the ink delivery module 140 by hand. In the automatic operation, a sensor (not shown) may be disposed inside the body 110, for example, and the sensor transmits a sensing signal back to a control center (not shown) after sensing the cover 120 opening relative the body 110, and then a program is used to control the second driving element 164 and the first driving element 162 to rotate relative to each other. In the present embodiment, the second driving element 164 is an irrotatable, incomplete gear fixed in the body 110, and the first driving element 162 is a rotatable gear. Therefore, the first driving element 162 is the one that rotates and leads the ink delivery module 140 to tilt clockwise along the shape of the second driving element 164.

In addition, to allow the user to inject ink into the cases conveniently, each of the case bodies 142 further has an ink injection opening 142*a*, wherein a side wall 142*b* of the case body 142 has the ink injection opening 142*a*. The side wall 142*b* faces the print head 130 when the cover 120 closes relative to the body 110.

In particular, the engagement of first driving element 162 and the second driving element 164 provides buffering and stabilization effects for the ink delivery module 140 when the ink delivery module 140 tilts clockwise, so that the ink inside the ink delivery module 140 is prevented from overflowing. Furthermore, with the mutual guidance and position limitation of the guide groove 164*a* of the second driving element 164 and the protruding axis 140*c* of the ink delivery module 140, the ink delivery module 140 tilts relative to the body 110 more stably, wherein the guide groove 164*a* is substantially curved.

Figure 3A:
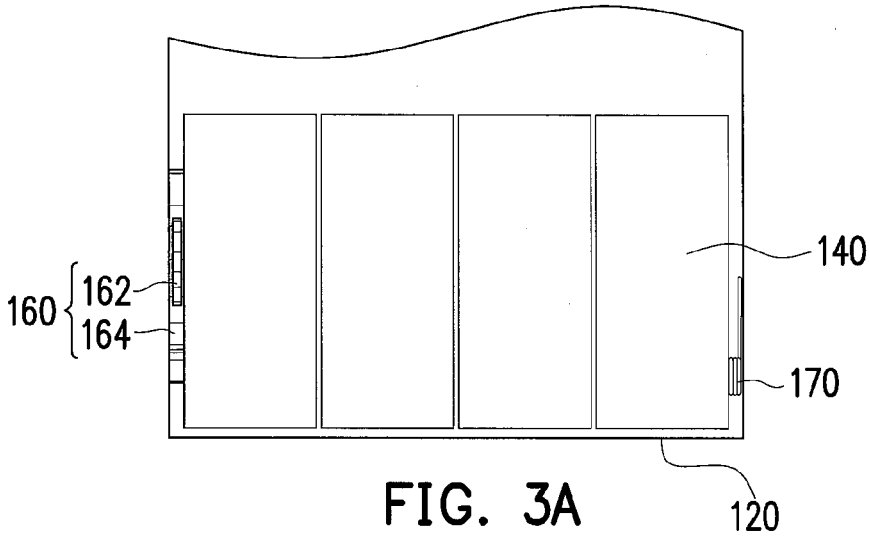
FIG. 3A is a partial top view of a multifunctional printer according to the present embodiment.
Figure 3B:
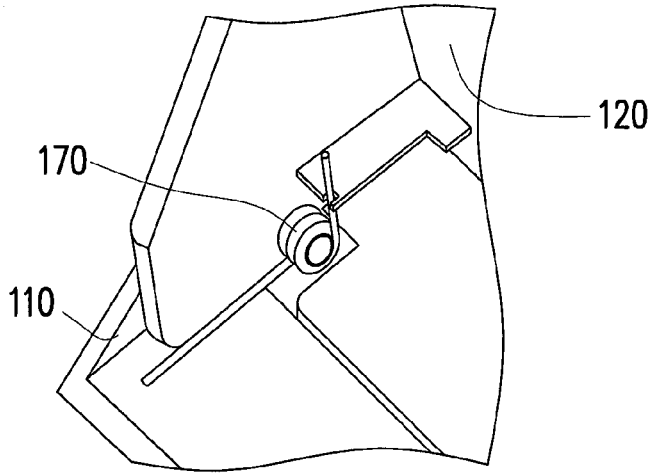
FIGS. 3B and 3C are schematic partial views of a torsional spring, a cover and a body shown in FIG. 3A.
Figure 3C:
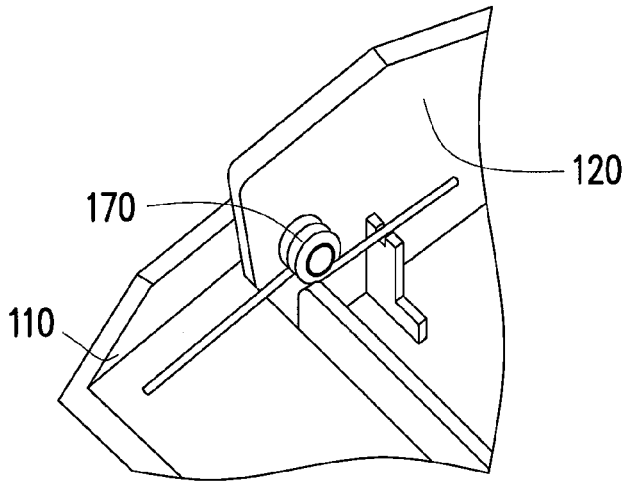

FIG. 3A is a partial top view of a multifunctional printer according to the present embodiment, and FIGS. 3B and 3C are schematic partial views of a torsional spring, a cover and a body shown in FIG. 3A. Referring to FIGS. 3A, 3B and 3C, a torsional spring 170 is disposed on a side of the ink delivery module 140 without the first driving element 162 disposed thereon, and the torsional spring 170 is between the ink delivery module 140 and a side wall of the body 110. The torsional spring 170 provides a buffering effect when the cover 120 rotates counter-clockwise to close relative to the body 110 (at this time, the ink delivery module 140 is usually filled with ink so the ink is rather full), so that the cover 120 leads the ink delivery module 140 to be slowly guided back counter-clockwise. In this way, the cover 120 closes slowly to prevent from generating bubbles due to violently shaking and also to prevent the ink from overflowing.

When the ink delivery module 140 tilts, the ink injection opening 142*a* is exposed, so the user may inject the ink into the ink injection opening 142*a* conveniently to add the ink into the case bodies 142.

When the ink is added to a sufficient amount, the user pushes the cover 120 back so that the cover 120 closes relative to the body 110. When the cover 120 rotates counter-clockwise, the ink delivery module 140 is also pushed back by the cover 120. In addition, when the first driving element 162 and the second driving element 164 engage with each other again, as the cover 120 pushes, the second driving element 164 and the first driving element 162 are linked together to drive the ink delivery module 140 back counter-clockwise slowly.

In addition, in the corresponding drawings of the present embodiment, the connection method of the ink delivery pipe 150 and the ink delivery module 140 is not specifically illustrated. The connection of the ink delivery pipe 150 and the ink delivery module 140 may be separable connection. In other words, the ink delivery pipe 150 and the ink delivery module 140 are bonded together when the cover 120 is closed relative to the body 110, and the ink delivery pipe 150 and the ink delivery module 140 are separated from each other when the cover 120 is open relative to the body 110. The connection method of the ink delivery pipe 150 and the ink delivery module 140 is not limited to the above. People of ordinary skill in the art may change the design according to actual needs.

In light of the above, the ink delivery module 140 of the multifunctional printer 100 of the present embodiment is built in the body 110. When there is a need to add the ink, the ink delivery module 140 may be exposed by opening the cover 120 relative to the body 110 to inject the ink. Therefore, the problem that the ink delivery module 140 is disposed outside the body 110 and occupies space does not happen to the multifunctional printer 100 of the present embodiment. In addition, the ink may be added to achieve the purpose of continuous ink delivery. Besides, the case bodies 142 of the cases do not have to be changed when the ink is used up and has to be renewed. Thus, environmental protection effects are also achieved.

Second Embodiment

Figure 4:
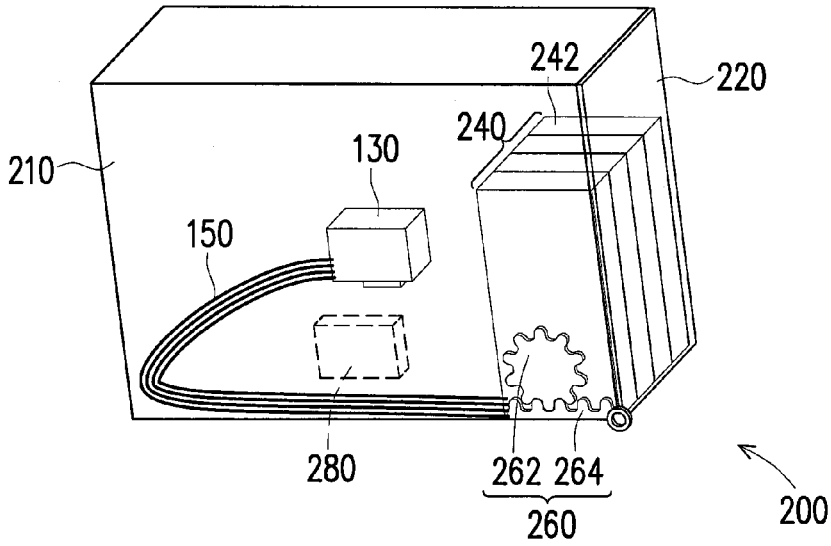
FIG. 4 is a schematic view of a multifunctional printer according to the second embodiment of the invention, wherein a cover is not open relative to a body.
Figure 5:
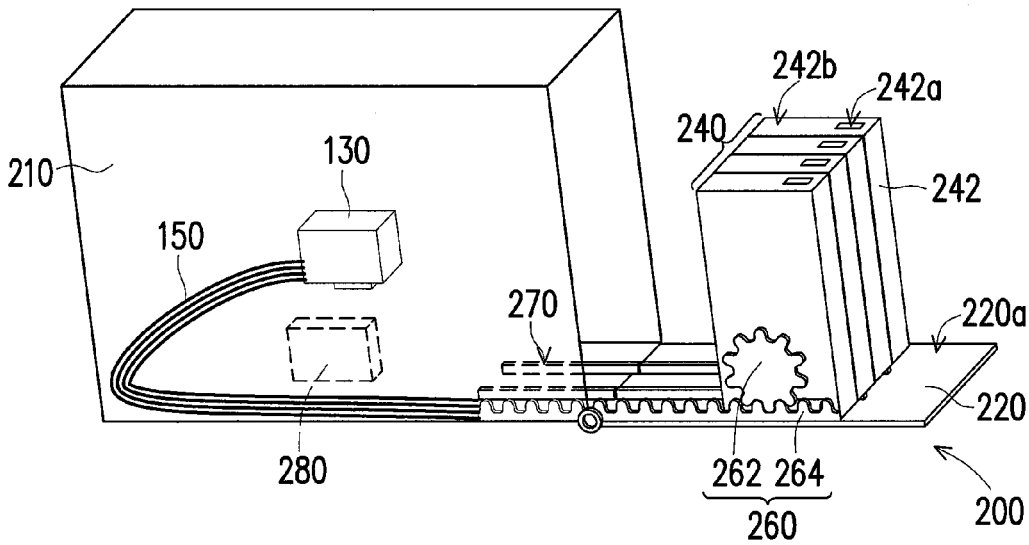
FIG. 5 is a schematic view of the multifunctional printer shown in FIG. 4, wherein the cover is open relative to the body.

FIG. 4 is a schematic view of a multifunctional printer according to the second embodiment of the invention, wherein a cover is not open relative to a body. FIG. 5 is a schematic view of the multifunctional printer shown in FIG. 4, wherein the cover is open relative to the body. Referring to FIGS. 4 and 5, in the present embodiment, a first driving element 262 is a gear, and a second driving element 264 is a gear rack, wherein a portion of the gear rack is disposed in a body 210, and the other portion of the gear rack is disposed on a surface facing a print head 130 when a cover 220 is closed relative to the body 210. The gear (the first driving element 262) and the gear rack (the second driving element 264) in the body 210 engage with each other. It should be noted that when the cover 220 is open relative to the body 210, the portion of the gear rack (the second driving element 264) in the body 210 is connected together with the portion of the gear rack (the second driving element 264) disposed on the cover 220 to form a complete bar-shaped gear rack. In addition, in the ink delivery module 240 of the present embodiment, a top wall 242*b* of a case body 242 has an ink injection opening 242*a*.

Referring to FIG. 4, when the cover 220 is closed relative to the body 210, the ink delivery module 240 is in the body 210, and the gear (the first driving element 262) engages with the gear rack (the second driving element 264) in the body 210. As shown in FIG. 5, after the cover 220 is open relative to the body 210, the gear rack (the second driving element 264) in the body 210 and the gear rack (the second driving element 264) disposed on the cover 220 are connected together and form a complete bar-shaped gear rack. The gear (the first driving element 262) rotates clockwise, and the ink delivery module 240 moves toward outside the body 210 (i.e. toward the right side in FIG. 5) by the engagement of the gear (the first driving element 262) and the gear rack (the second driving element 264).

To prevent the ink delivery module 240 from disengaging from the gear rack (the second driving element 264), a stop structure (not shown), such as a convex rib, a convex column or a convex dot, may be disposed on the cover 220 to limit a moving distance for which the ink delivery module 240 moves along the gear rack (the second driving element 264). The design and application of the stop structure may vary according to actual needs and are not limited to the above examples of the convex rib, the convex column or the convex dot. The number of turns of the first driving element 242 as a gear controlled by program may also be used to control the moving distance for which the ink delivery module 240 moves on the gear rack (the second driving element 264).

When the ink delivery module 240 moves on the cover 220 to a predetermined point and stops moving, the user may inject the ink into the case body 242 through the ink injection opening 242*a* conveniently because the top wall 242*b* of the case body 242 has the ink injection opening 242*a*.

In addition, the ink delivery module 240 moves from inside of the body 210 to outside of the body 210 by the cooperation of the gear (the first driving element 262) and the gear rack (the second driving element 264). Furthermore, since the top wall 242*b* of the case body 242 has the ink injection opening 242*a*, the ink in the ink delivery module 240 of the present embodiment is less likely to overflow compared with the first embodiment.

In addition, the multifunctional printer 200 may further include a pair of slide rails 270 disposed in the same way as the second driving element 264. In other words, a portion of the slide rails 270 is disposed in the body 210, and the other portion of the slide rails 270 is disposed on a surface 220*a* of the cover 220 facing the print head 130 when the cover 220 is closed relative to the body 210. In addition, when the cover 220 is open relative to the body 210, the portion of the slide rails 270 located in the body 210 and the portion of the slide rails 270 on the surface 220*a* of the cover 220 are connected together. The disposition of the slide rails 270 supports the ink delivery module 240 and further increases the stability when the ink deliver module 240 moves.

Moreover, the multifunctional printer 200 may further include a power source 280 disposed inside the body 210, wherein the power source 280 is a motor or an electromagnetic valve, and when the cover 220 is open relative to the body 210, the power source 280 drives the ink delivery module 240 to move from inside the body 210 to on the cover 220. The power source 280 may be under automatic control of programs or under manual control. Specifically, when the user opens the cover 220, a program may be used to automatically control the ink delivery module 240 to move to outside of the body 210. The manual control method is disposing a button, for example. When the user presses the button, the power source 280 is activated to drive the ink delivery module 240 to move.

In summary of the above, the ink delivery module of the multifunctional printer of the invention is located in the body in a normal state. The ink delivery module moves relative to the body only when the cover is open relative to the body, so that the ink injection opening of the case body of the ink delivery module is exposed outside the body to allow the user to add ink conveniently.

Compared with a conventional inkjet printer which requires the ink cartridge to be dismantled and entirely changed when the ink is used up, the multifunctional printer of the invention allows the ink to be added into the cartridge; therefore, the cartridge bodies of the ink cartridges may be reused, and environmental protection effects are achieved.

Compared with another conventional way of disposing ink delivery containers outside the bodies of the inkjet printers for continuous ink delivery, the multifunctional printer of the invention hides the ink delivery module inside the body and moves the ink delivery module outside the body through the cooperative operation of mechanic elements to allow the user to add ink conveniently when ink needs to be added.

Although the invention has been described with reference to the above embodiments, they are not intended to limit the invention. It is apparent to people of ordinary skill in the art that modifications and variations to the invention may be made without departing from the spirit and scope of the invention. In view of the foregoing, the protection scope of the invention will be defined by the appended claims.

What is claimed is:

1. A multifunctional printer, comprising:

a body;

a cover pivoted to the body adapted for opening relative to the body and exposing a plurality of elements in the body;

a print head disposed inside the body;

an ink delivery module disposed in the body and adjacent to the cover, wherein the ink delivery module has a plurality of color cases;

an ink delivery pipe connected between the print head and the ink delivery module; a driving module, comprising:

a first driving element disposed on the ink delivery module; and a second driving element disposed on at least one of the body and the cover and engaging with the first driving element.

2. The multifunctional printer according to claim 1, wherein the cover is made of light-transmissive materials.

3. The multifunctional printer according to claim 1, wherein the ink delivery module comprises a yellow case, a red case, a blue case and a black case.

4. The multifunctional printer according to claim 1, wherein each of the cases of the ink delivery module has a case body, and the case body is made of light-transmissive materials.

5. The multifunctional printer according to claim 1, wherein both the first driving element and the second driving element are gears, and the second driving element is disposed in the body.

6. The multifunctional printer according to claim 5, wherein the second driving element has a guide groove, the ink delivery module has a protruding axis, and the protruding axis penetrates into the guide groove to be guided and limited in position by the guide groove.

7. The multifunctional printer according to claim 5, wherein the second driving element has a protruding axis, the ink delivery module has a guide groove, and the protruding axis penetrates into the guide groove to be guided and limited in position by the guide groove.

8. The multifunctional printer according to claim 5, further comprising a damping element disposed on a side of the ink delivery module without the first driving element disposed thereon, the damping element contacting against the body and the cover.

9. The multifunctional printer according to claim 8, wherein the damping element is a torsional spring.

10. The multifunctional printer according to claim 5, wherein each of the cases of the ink delivery module comprises a case body, the case body has a side wall and an ink injection opening, and the side wall of the case body has the ink injection opening facing the print head.

11. The multifunctional printer according to claim 1, wherein the first driving element is a gear, the second driving element is a gear rack, a portion of the gear rack is disposed in the body, and the other portion of the gear rack is disposed on the cover.

12. The multifunctional printer according to claim 11, wherein each of the cases of the ink delivery module has a case body, the case body has a top wall and an ink injection opening, and the top wall has the ink injection opening.

13. The multifunctional printer according to claim 11, further comprising a pair of slide rails, a portion of the slide rails is disposed in the body, and the other portion of the slide rails is disposed on a surface of the cover, wherein the surface faces the print head when the cover is closed relative to the body.

14. The multifunctional printer according to claim 13, further comprising a power source disposed inside the body, wherein when the cover is open relative to the body, the power source drives the ink delivery module to move from inside the body to on the cover.

15. The multifunctional printer according to claim 14, wherein the power source is a motor or an electromagnetic valve.

* * * * *